US006367797B1

(12) United States Patent
McKenna-Cress et al.

(10) Patent No.: US 6,367,797 B1
(45) Date of Patent: Apr. 9, 2002

(54) MINIATURE GOLF GAME AND METHOD

(76) Inventors: Polly McKenna-Cress; Richard Cress, both of 110 Elfreth's Alley, Philadelphia, PA (US) 19106; Ned Drew, 519 E. 87th St., #2A, New York, NY (US) 10028; Dave Georger, 40 W. 95th St., Apt. 4E, New York, NY (US) 10025; Celene Judge, 325 E. 78th St., #2B, New York, NY (US) 10021

( * ) Notice: Subject to any disclaimer, the term of this patent is extended or adjusted under 35 U.S.C. 154(b) by 0 days.

(21) Appl. No.: 09/637,637

(22) Filed: Aug. 14, 2000

Related U.S. Application Data

(60) Provisional application No. 60/148,636, filed on Aug. 12, 1999.

(51) Int. Cl.[7] ..... A63F 7/06
(52) U.S. Cl. ..... 273/108.2
(58) Field of Search ..... 273/108.1, 108.2, 273/108.21, 317.2

(56) References Cited

U.S. PATENT DOCUMENTS

| | | | | |
|---|---|---|---|---|
| 648,336 A | | 4/1900 | Bellamy | |
| 1,763,205 A | | 6/1930 | Winbigler | |
| 3,534,961 A | * | 10/1970 | Tiley | 473/108.21 |
| 3,578,333 A | | 5/1971 | Elesh | |
| 3,735,988 A | | 5/1973 | Palmer et al. | |
| 3,809,404 A | * | 5/1974 | Fikse | 473/317.2 |
| 4,095,793 A | * | 6/1978 | Ray | 473/108.21 |
| 4,322,081 A | * | 3/1982 | Terry, Jr. et al. | 473/317.2 |
| 5,538,253 A | | 7/1996 | Foster | |
| 5,575,483 A | | 11/1996 | Dineen et al. | |
| 5,636,844 A | | 6/1997 | de Buys | |
| 5,988,636 A | * | 11/1999 | Kilmer | 473/108.1 |

OTHER PUBLICATIONS

"the cocktail golf rug", p. 2, Wall Street Journal, Mar. 9, 1961 (copy located in 273/87R).*
"Marble Golf", p. 165, Book of 1000 Family Games, 1971 (copy located in 273/87R).*

* cited by examiner

*Primary Examiner*—Raleigh W. Chiu
(74) *Attorney, Agent, or Firm*—Fulbright & Jaworski, LLP

(57) ABSTRACT

A portable, "design-your-own course" miniature golf game utilizing replica golf greens, plastic or rubber tees and balls for play at beaches, lakes or where large sandy areas are available. Players design and build their own course in the sand using implements provided with the game. The game is played by alternately using one's thumb, index or middle fingers to thump ("hit") the ball in a desired direction or trajectory. The game is based largely on the conventional rules of golf, with specific regulations addressing hand and finger positions and striking techniques for putting the ball in play. Game implements, along with a water-resistant score card and rule book, are packaged in a lightweight, collapsible bag designed to resemble a golf bag.

10 Claims, 6 Drawing Sheets

GREEN 1

GREEN 4

GREEN 2

GREEN 5

GREEN 3

GREEN 6

Fig. 5A
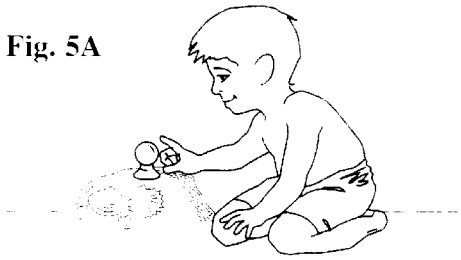
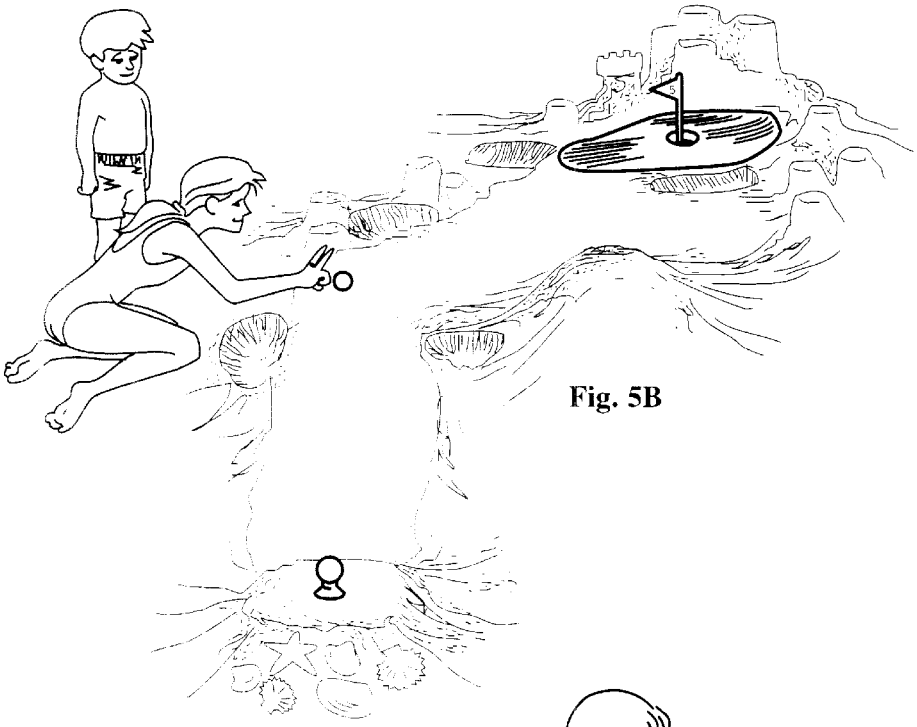
Fig. 5B
Fig. 5C
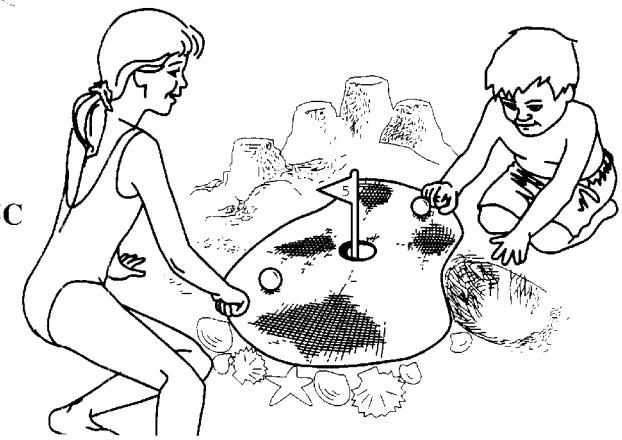

MINIATURE GOLF GAME AND METHOD

This application claims benefit under 35 U.S.C. 119(e) to U.S. Provisional Application Ser. No. 60/148,636, filed Aug. 12, 1999.

BACKGROUND OF THE INVENTION

1. Field of the Invention

This invention relates to recreational games, beach games and specifically miniature golf.

2. Description of Related Art

Prior patents disclose miniaturized aspects of golf simulation games and the like.

U.S. Pat. No. 648,336, issued to Bellamy in 1900 describes a game the principal feature of which is a "finger attachment adapted to be used for the same purpose that a golf stick, club, or flicker is used." Absent from Bellamy are rules or regulations to guide the play and a discernible course on which to execute the striking finger motion to bring the "attachment" into play.

U.S. Pat. No. 1,763,205, issued to Winbigler in 1924, is described as "providing a golf game that may be readily packed within a small space and transported at the will of the player." The principal feature of the invention consists of a finger attachment adapted to "provide a unique club holder and unique miniature clubs for use in playing." Winbigler's attachment is used to play a simulated miniature golf game on a revolving course board designed to allow for play in limited spaces such as a tabletop.

U.S. Pat. No. 5,575,483, issued to Dineen et al. in 1995, is described as a "transportable and inexpensive golf toss game in which players toss bags at receptacles simulating golf holes arranged and set up on a playing course resembling a golf course." The player stands upright with his or her feet planted at the starting point marker and tosses a bag using an underhand motion. Dineen's invention involves plotting a playing course in an outdoor area to resemble a golfcourse, positioning and securing markers on the playing course to identify the holes, and provide portable packaging.

U.S. Pat. Nos. 5,636,844, 5,538,253, and 3,578,333 issued to de Buys, Foster, and Elesh, respectively, relate to a simulated golf games which utilize a light-weight ball to be shot or hit toward a green using a standard type of golf club to manipulate the direction and trajectory of the ball.

U.S. Pat. No. 3,735,988, issued to Palmer et al. in 1973, embodies apractice putting surface and does not relate to the actual simulation of a miniature golf game.

SUMMARY OF THE INVENTION

The present invention is a family and group game combining the relaxation of the beach with the fun and competition of golf. Players design their own holes, complete with tees, fairways and approaches. Building and customizing the course for fun or challenge is a significant part of the game play.

The game is played much like conventional golf, albeit on a much smaller course. However, the ball is advanced by thumping it (the golf "swing") with one's finger (the golfer's "club"). The middle finger is the "driver," the index finger is the "putter," and the thumb is the "wedge" used for chip shots and hazards (see FIG. 4A, 4B, 4C).

The preferred embodiment of the invention utilizes a miniature nylon golf bag (see FIG. 1) containing a rule book including suggested course layouts (see FIG. 6) and brief trivia on each hole; six greens preferably made of reinforced rubber matting (see FIG. 2); six (6) balls (see FIG. 3A); six (6) elevated tees (see FIG. 3B); six (6) flags (see FIG. 3C); one (1) pad of score cards with pencils. The balls should be sufficiently heavy to carry in the wind over short distances. A "smash" ball with a diameter of about 1.5 inch and made of rubber is commonly used is well known paddle games and has been found to be suitable for use in the invention. All of the materials are waterproof and reusable except the scorecards. The greens and suggested hole designs provided with the game can be modeled after famous golf courses.

BRIEF DESCRIPTION OF THE DRAWINGS

The objects and advantages of the present invention will become more readily apparent to those ordinarily skilled in the art after reviewing the following detailed descriptions and accompanying drawings, wherein:

FIG. 5A shows a player teeing off at the tee box. Tee box is raised and allows space for the player to rest his hand behind the tee.

FIG. 5B shows a complete hole with tee box, bunkers, obstacles of various sorts, and position of green and flag. Fairway is smoothed flat to provide better ball movement.

FIG. 5C shows a closer view of players at the putting green.

As driving distances average about 3 feet, par should be determined by this measure. Of course, since the players are encouraged to create their own courses, this layout is for reference only, and can be altered in any manner desired.

DETAILED DESCRIPTION OF THE INVENTION

1. SPACE AND SIZE

First, a player must locate a comfortable place on the beach or sandy area to build the course. If space is limited, only up 2 or 3 holes may be played.

Figure 6:
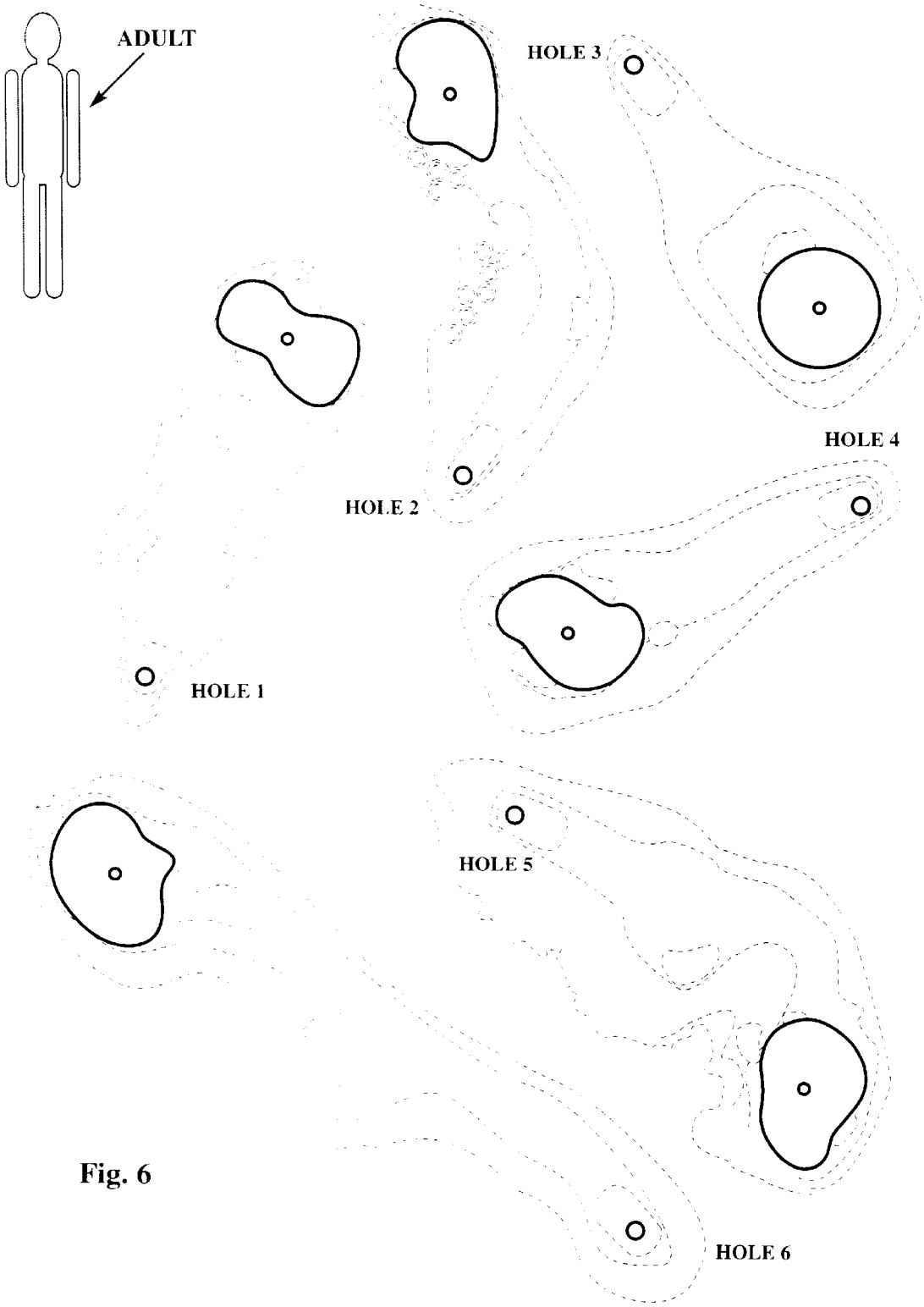
FIG. 6 shows a course design, with holes arranged in the most convenient manner—tee box next to each green. A relative scale adult figure provides some scale reference for the course size.

Driving distance will vary with each player depending on age and ability, however, the average driving distance is approximately three feet. Therefore, a par four hole would be approximately twelve feet. (see FIG. 6) Designing and building the course allows the player the necessary flexibility to tailor the game to entertain the beginner or challenge even the most seasoned player.

Each hole in a basic course will have a tee-off area ("tee box"), fairway, and green. Ample space should be allocated between each course hole to provide players with free movement and unhampered approaches to shots. Example: A player should not be kneeling in fairway #3 while playing on fairway #2—the course could become easily disturbed in this way.

a. Tee Box

The tee box should be raised from the surface to allow for easy tee-off approach with ample space behind the tee to rest one's hand (see FIG. 5A). The tee box can be made with a small, wellpacked mound of sand. Setting different distances (from the hole) for "Ladies" and/or "Pro" tees is optional. A practice tee elevates the ball sufficiently to be hit with the middle finger. A suitable tee is a rubber tee made by Golf Concepts of Utah.

b. Fairways

The fairway area should be flat and smooth to facilitate free ball movement, and to distinguish the fairway from the "rough" (all area outside the course). As in traditional golf, the player is encouraged to stay within the fairway. The "rough" area could be made rougher to discourage any shortcuts to the green.

Players can use their arms, a rake, stick, or other long flat object to aid in smoothing out fairway areas for the course. It is recommended to roughly mark out each of the six fairway areas before more detailed construction of the course continues. In this way, comfortable spacing between holes, and traffic areas around them can be accurately determined.

c. Greens and Holes

Figure 1:
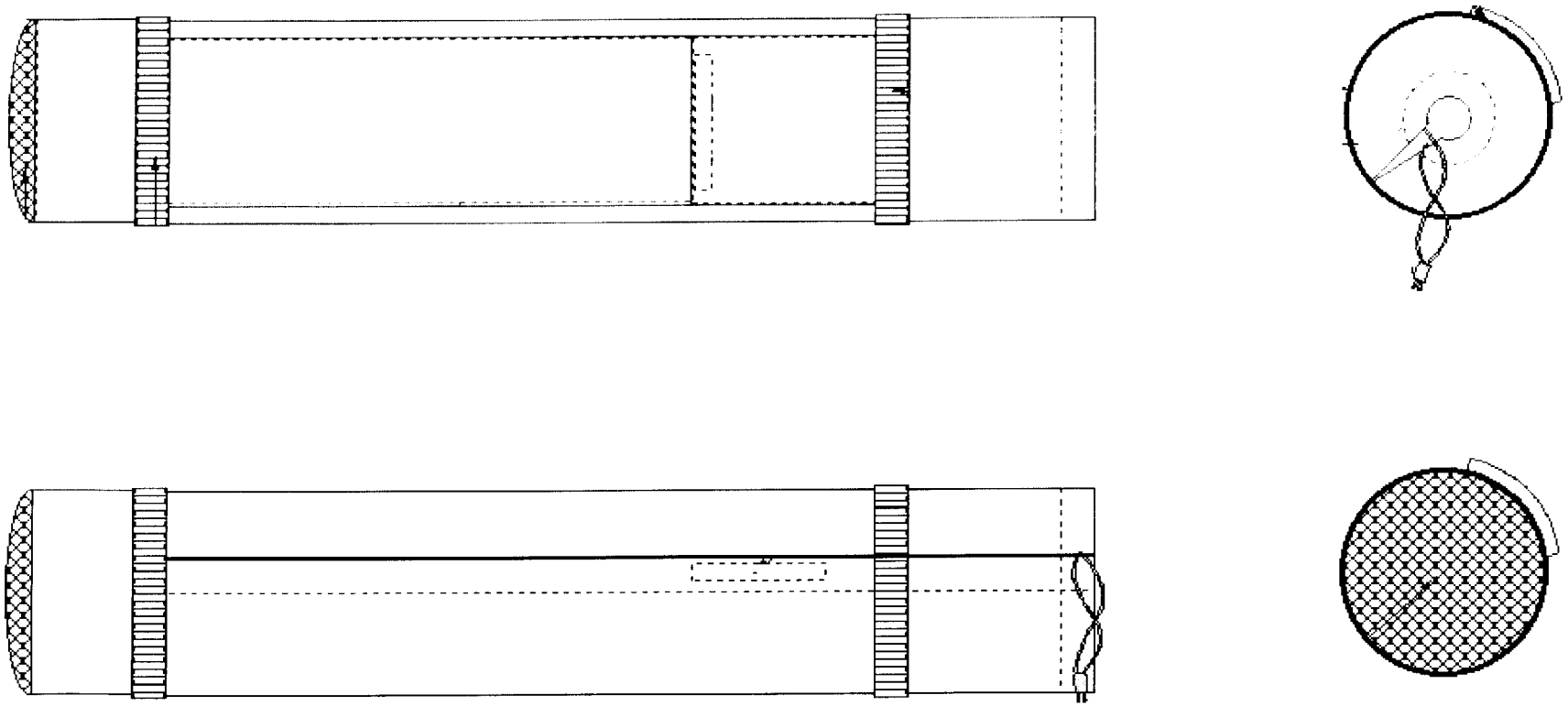
FIG. 1 is a front view, side view, top and bottom view of the bag design, which is used to contain all the implements of the game. String ties and Velcro provide for easy opening, packing and unpacking the game. Interior pocket holds balls, tees, rule book and score cards. Greens are rolled up to fit inside bag. The bottom of bag is mesh nylon to allow sand to escape the bag to keep it clean.
Figure 2:
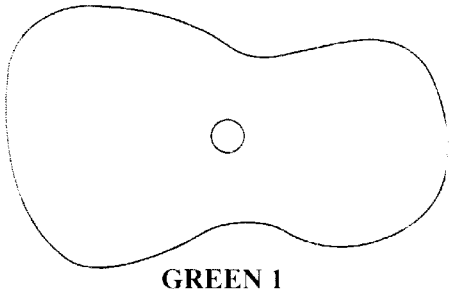
FIG. 2 is a plan view of six typical greens provided with the game. Composed of a waterproof, flexible rubber material, the greens are of a pre-cut shape with a hole, and modeled after famous golf holes if desired. Each green is numbered. Greens are stacked together and rolled to be packed away into game bag.
Figure 2:
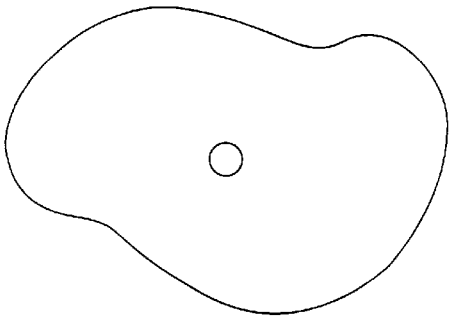
Figure 2:
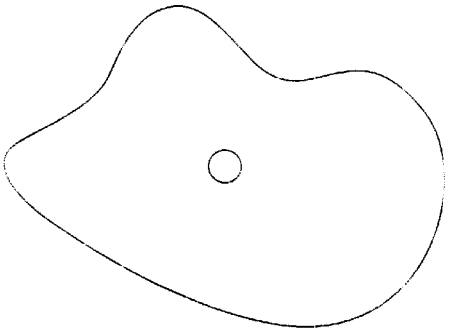
Figure 2:
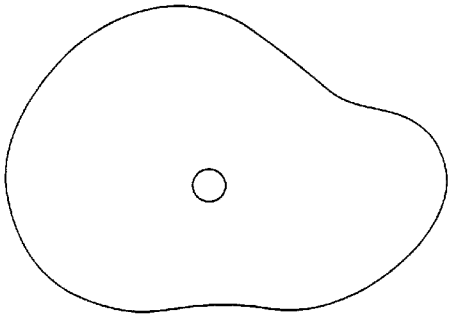
Figure 2:
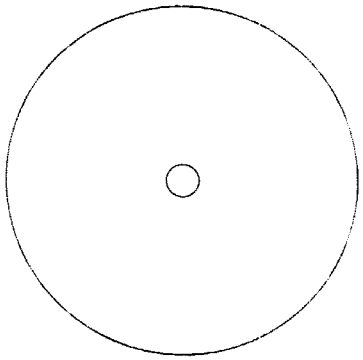
Figure 2:
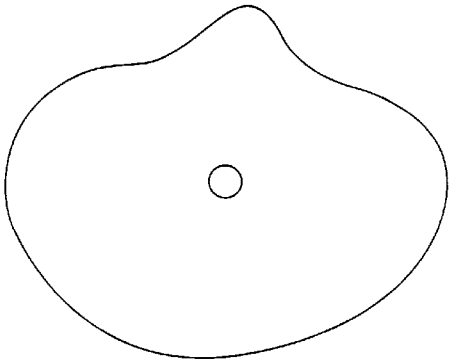
Figure 3A:
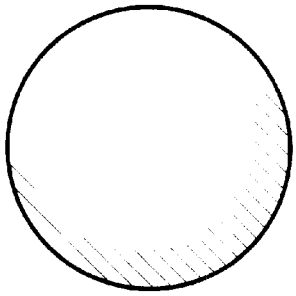
FIGS. 3A, 3B, and 3C comprise game components: the ball, tee, and flag. The ball can be a hollow dimpled rubber ball and the tee can also be rubber. Soft plastic balls and tees can also be used. The flagstick can be molded plastic, and numbered individually for each hole. A small, blunt pin at the bottom allows the flag to stand in sand.
Figure 3B:
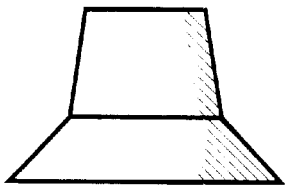
Figure 3C:
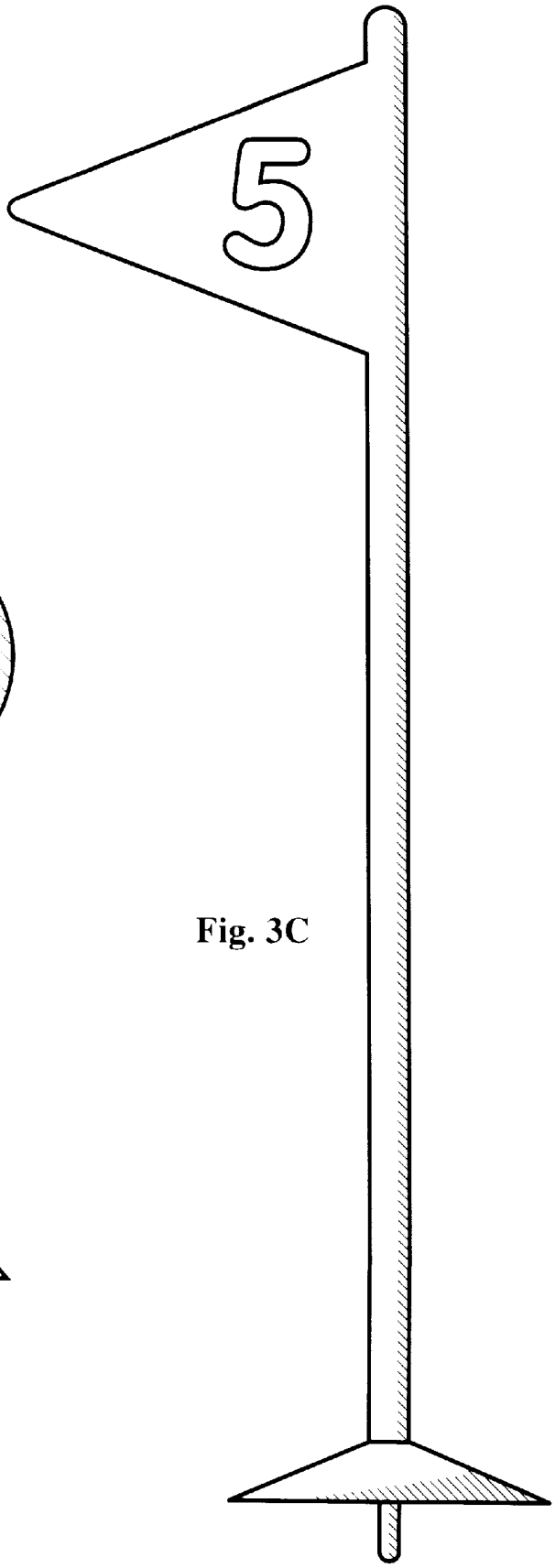

The green should be placed on a smooth, flat, and relatively level area, with the "cup" dug out of the sand beneath the hole in the green (see FIG. 5C). Greens placed on uneven surfaces can prove more challenging but also frustrating to conquer. Numbered flags (FIG. 3C) corresponding to each hole are placed inside the "cup" to aid accuracy and clear delineation of the course, but can be removed while putting. The greens can be made from reinforced rubber matting conventionally used as a shelf liner or a non-skid rug mat. Suitable matting is made by Grip Tech Manufacturing.

d. Bunkers, Hazards, and Special Features

Sandcastles, deep bunkers or tunnels, water hazards, shells, driftwood, seaweed, or various beach toys may all be utilized when designing a course. Creativity is the only guideline for building challenging hazards, traps and obstacles. (see FIG. 5B and 5C).

2. RULES OF THE GAME

It should be noted that, unless specifically defined herein, the rules of regulation golf, as defined by the United States Golf Association, shall apply in the preferred embodiment of the game of the subject invention. As this is a 6-hole course, players should decide before hand how many rounds they will play, and agree on the par for each hole. (Re: the overall length of the hole generally determines the par See Sec. 1 Designing the Course and FIG. 6). Each swing shall count as a stroke against par, and upon completion of a hole, the player's total strokes are marked down as the score for the hole. The player with the lowest score for a pre-designated number of holes wins.

a. Tee Off

When starting the game, players can decide the order of tee-off by flipping a coin, etc. On subsequent holes, the player with the lowest score on the prior hole will tee off first. A player places his colored ball (FIG. 3A) on the rubber tee (FIG. 3B), rests the base of the hand on a flat surface behind the tee, and hits the ball using the middle finger. (See FIG. 4A and 5A) The middle finger is the main implement (the "driver") for advancing the ball to the green, and generally provides more strength and power thus greater distance on a shot.

Figure 4A:
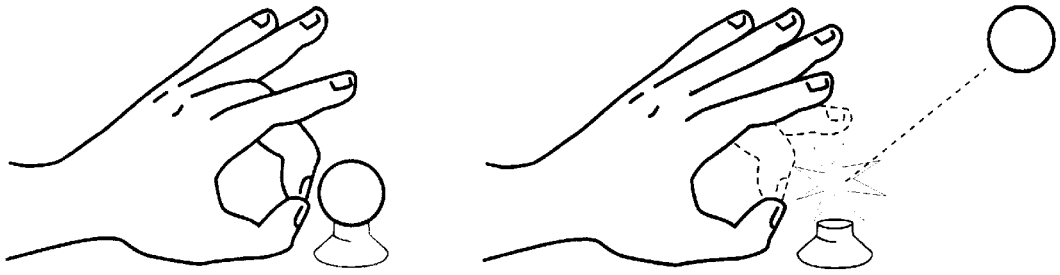
FIG. 4A shows a two-part demonstration of the drive technique using the middle finger. The player strikes the ball in a quick, "thumping" motion. The middle finger provides greater strength and distance on the shot.
Figure 4B:
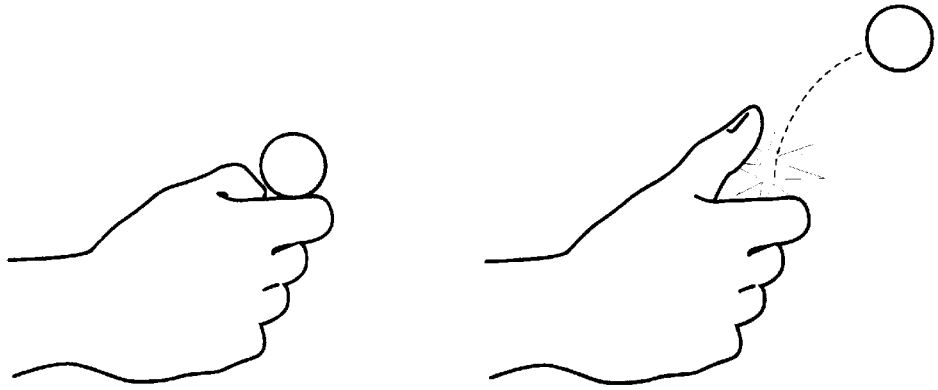
FIG. 4B shows a two-part demonstration of the chipping technique using the thumb. When the player's ball lies in a bunker or behind a hazard, he is allowed to place his fist down where the ball lies, place the ball on the thumb and index finger for balance. The ball is popped upward by the thumb just like flipping a coin.
Figure 4C:
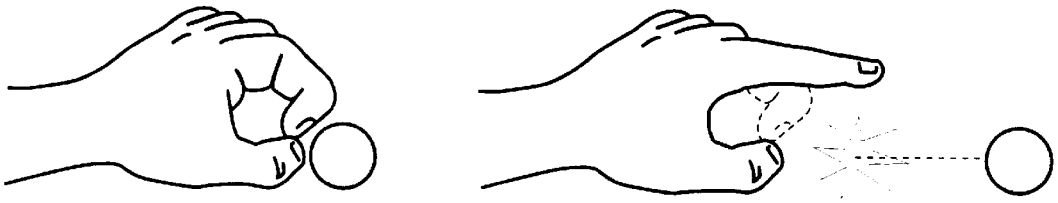
FIG. 4C shows a two-part demonstration of the putting technique using the index finger for greater control and accuracy.

Players are not allowed to use a foreign object to hit the ball. Players are not allowed to use their hand, arm, wrist, elbow or any part of their body other than their finger or thumb to hit the ball. Players are not allowed to bat, swing or poke the ball in a backhanded or underhanded motion. Players are not allowed to use multiple fingers together to hit the ball. The ball must be hit with a single finger only, as illustrated in FIGS. 4A, 4B, and 4C. Ring finger or pinky finger is not recommended, as they do not provide sufficient power for a swing.

b. Fairway Drives

As in regulation golf, players are allowed to use a tee only for the first drive of each hole. From where the ball lands (its "lie"), each player attempts to advance the ball towards the green using the same "driver"—the middle finger—described in the tee shot yet without utilizing a tee. (see FIG. 5B). As part of the game, players must observe traditional golf etiquette, allowing the player who is "away" (or furthest from the hole) to shoot first. As the game is played in sand, the course can become disturbed with footprints, handprints, and ball marks. Rudimentary course grooming as the game progresses—"replacing one's divots"—by smoothing the course surface after a shot is common courtesy.

c. Chipping

When a ball lands in a bunker (usually holes dug around the course) or behind other course obstructions, players are allowed to "thumb chip." This technique involves placing one's closed fist on the spot where the ball lands, then setting the ball on the tip of the thumb and "popping" the ball in an upward motion—just like flipping a coin. (see FIG.4B). This is the only approved means of chiping. Players can not throw, flip, scoop, or propel the ball out of a trap by any other means. As in traditional golf, this type of shot is difficult and may take some practice to master.

d. Putting

Once on the green, a player must sink the putt to finish the hole. Unlike tee and fairway shots that utilize the middle finger as the striking implement, players utilize the index finger to hit the ball towards the hole in order to sink the putt. (See FIG. 4C) The index finger typically provides more control for accurate putting, by using a much lighter "thump" than for a drive or chip shot. Players cannot push the ball forward with the index finger—the ball should be hit with the finger.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. Portable, "design-your-own course" miniature golf game comprising:

a. water-resistant rubber mesh greens with a center hole and an outer shape to resemble golf holes;

b. hollow rubber balls;

c. numbered flags to be placed on the course; and d. tees to hold the ball while teeing off.

2. Golf game of claim 1, wherein said greens are cut to resemble famous golf holes.

3. Golf game of claim 1 including a game bag.

4. Golf game of claim 1 including a water-resistant booklet containing all game rules, suggested course layouts, hazards, obstacles, and other game information.

5. Golf game of claim 1 including score sheets for players to mark down scores.

6. Method of playing the golf game of claim 1, wherein designing and building the course in the sand is the first significant part of the fun, comprising the steps of:

a. plotting a playing course in a sandy outdoor area with tee box, fairway and green areas for each hole;

b. creating obstacles, hazards and traps for each hole to challenge the players;

c. utilizing rubber greens, tees and flags in course set up; and d. grooming the course during game play.

7. Method of claim 6, wherein the index or middle fingers or thumb are utilized as "clubs" to advance the ball by thumping the ball in a desired direction.

8. Method of claim 6, wherein the middle finger is used as the "driver," to thump the ball off the tee into the fairway.

9. Method of claim 6, wherein the thumb is used as the "wedge" or "sand wedge" to thump the ball out of traps, around or over hazards and obstacles.

10. Method of claim 6, wherein the index finger is used as the "putter," to thump the ball towards the hole, once the ball is on the green.

* * * * *